US005096329A

United States Patent [19]

Haile

[11] Patent Number: 5,096,329

[45] Date of Patent: Mar. 17, 1992

[54] DRUNK DRIVER DETECTION SYSTEM

[76] Inventor: Ernest Haile, 30 Cadwalader Terr., Trenton, N.J. 08618

[21] Appl. No.: 624,900

[22] Filed: Dec. 10, 1990

[51] Int. Cl.[5] ..... E01F 9/06; E01C 7/00; G08G 1/01; H01H 3/14

[52] U.S. Cl. ..... 404/12; 340/933; 200/86 A; 404/71; 404/6

[58] Field of Search ..... 340/928-933, 340/940, 573, 576; 404/6, 12, 71, 13, 14, 15; 180/271-274; 200/86 A

[56] References Cited

U.S. PATENT DOCUMENTS

| | | | |
|---|---|---|---|
| 1,836,655 | 12/1927 | Dunford | 200/86 A |
| 1,999,661 | 12/1929 | Nagashev | 200/86 A |
| 2,403,277 | 11/1941 | Hall | 200/86 A |
| 4,250,434 | 2/1981 | Valansot | 200/86 A |
| 4,716,413 | 12/1987 | Haile | 340/928 |
| 4,839,480 | 6/1989 | Bickley | 340/933 |

FOREIGN PATENT DOCUMENTS

| | | | |
|---|---|---|---|
| 7503989 | 9/1975 | France | 200/86 A |

*Primary Examiner*—Ramon S. Britts
*Assistant Examiner*—Nancy Connolly

[57] ABSTRACT

Disclosed is an improved system for quick detection of driver impairment as evidenced by the driver's inability to keep a vehicle on an assigned course, utilizes parallel strips defining a relatively narrow lane through which the driver is to operate the vehicle. The strips and their associated equipment, are readily portable, and are thus adapted to be set up by police officers at any location desired, in a minimum amount of time, thereby permitting spot checks with little or no advance warning to motorists approaching the check point. The strips are hollow, and contain pressure chambers, the volume of which is reduced when a vehicle tire crosses or rides along on top of one of the strips. Reduction of the pressure chamber volume is adapted to carry air pressure through tubes to locations near to or remote from the hollow strips to actuate electrical switches located at predetermined intervals along and out from the traffic lane defined by the hollow strips. The switches in turn close circuits, to turn on signal lamps or to actuate other apparatus.

3 Claims, 3 Drawing Sheets

24R
36
12
48
7
22R
20R
3
4
38
44
42
46
40
52
50
18
S
T

DRUNK DRIVER DETECTION SYSTEM

BACKGROUND OF THE INVENTION

1. Field of the Invention

The present invention relates generally to the category of equipment adapted to be set up on an open highway, for the purpose of checking the possible impairment, due to alcohol, of motorists. In a more specific sense, the equipment is of the type utilizing a pair of portable strips between which a driving lane is defined, with said strips being adapted to be quickly attachable to the highway surface, in positions such as to require that the motorists pass therebetween, and do so in a manner that will quickly indicate whether or not they are capable of operating a vehicle safely, in the sense of maintaining their vehicles along a proper course.

2. Description of the Prior Art

In widespread use is the road block, sobriety check point system, in which all vehicles may be stopped and the drivers briefly questioned for signs of driver impairment. Indications are that less than one percent of drivers are drunk drivers; hence police officers may have to stop and question 99 sober unimpaired drivers before apprehending a drunk driver.

The problem of checking a large number of drivers for driver impairment while causing minimal inconvenience to sober unimpaired drivers is a problem that should be solved. U.S. Pat. No. 4,716,413 discloses a means of detecting driver impairment; in that patent, an electrical switch is located in one end of each section of boundary lane strip where it may be run upon and damaged. The objects of the present invention are to lessen the chances of damage to electrical switches and to reduce the number of switches by one half, thereby improving upon U.S. Pat. No. 4,716,413 by providing a more economical system for detecting driver impairment.

SUMMARY OF THE INVENTION

Summarized briefly, the present invention involves the provision, basically, of a pair of elongated strips, each of which comprised of a plurality of readily separable sections. The provision of the strips in sections of manageable lengths permits them to be swiftly taken up from a highway surface, stored in a truck, and removed for relocation at another point where spot checks are to be made for driver impairment.

In accordance with the invention, each strip is preferably formed of rubber or other flexible, durable material, in such a fashion as to define within each strip a pressure chamber that extends the length thereof. The chamber is defined, in part, by a top wall that is specifically designed to be depressed whenever a vehicle tire rides over it or along on the strip lengthwise. Depression of the top wall of the pressure chamber of any section of the strip in turn forces air through tubes from the strips to locations near to and remote from the strips and activates electrical switches at such locations, which in turn may transmit signals to police officers standing by. In this way, any vehicle that does not negotiate the driving lane defined between the strips can be stopped immediately, while other vehicles that remain within the lane from end to end thereof can be permitted to proceed on their way without inconvenience, and without causing loss of time.

In accordance with the invention, the strips may be so designed as to be set up at any desired transverse distance from each other, whereby to permit the lane to be made as narrow as is permitted by legislation, or possibly within the discretion of the police officers operating the spot check for driver impairment. The invention further provides that the test lane consists of a series of compound curves, requiring operation of the steering wheel in such a manner as to require that the driver be in full possesion of his faculties in order to negotiate the lane successfully without activating any signals.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
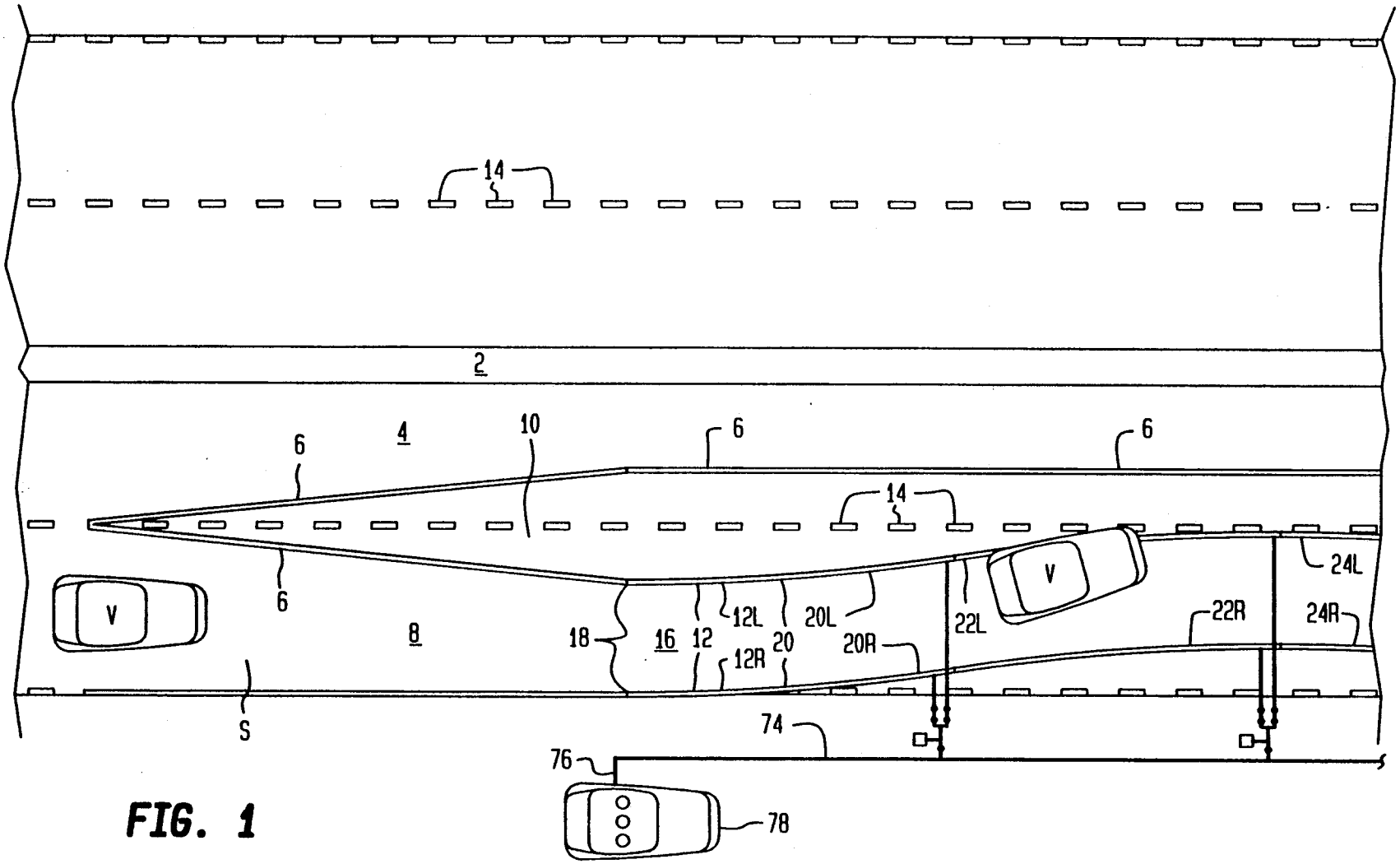
FIG. 1 is a top plan view of a highway surface, illustrating a car entering the narrowing traffic lane that leads into the narrow lane defined by the signaling boundary lane strips, and another car failing to stay within the test lane as equipment of the present invention is utilized.

Referring to the drawings in detail, FIG. 1 shows a four lane highway, Consisting of two lanes in opposite direction of two other lanes, separated by typical reinforced concrete medial barrier 2. The left lane 4 of two same direction lanes is narrowed temporarily by using non signaling straight boundary lane markings 6 in a direction away from the right-hand lane and the right-hand lane 8 is likewise narrowed 6 away from the left lane, leaving a space 10 between the two lanes to promote a safer operation. Thus, both lanes are narrowed from the possible 12 ft. standard width to 9 feet. The right-hand lane is selected to be the test lane and the left-hand lane is designated as a by-pass lane for large trucks, buses and other vehicles not suited for the test lane.

The present invention comprises a pair of parallel, like, inspection lane boundary strips 12 adapted to be temporarily attached to a highway surface S having conventional driving lane markings 14, so that the boundary strips 12 define an inspection or check lane of reduced width, which must be negotiated by a vehicle V.

Figures 2, 3, 4, 5, 6, 7:
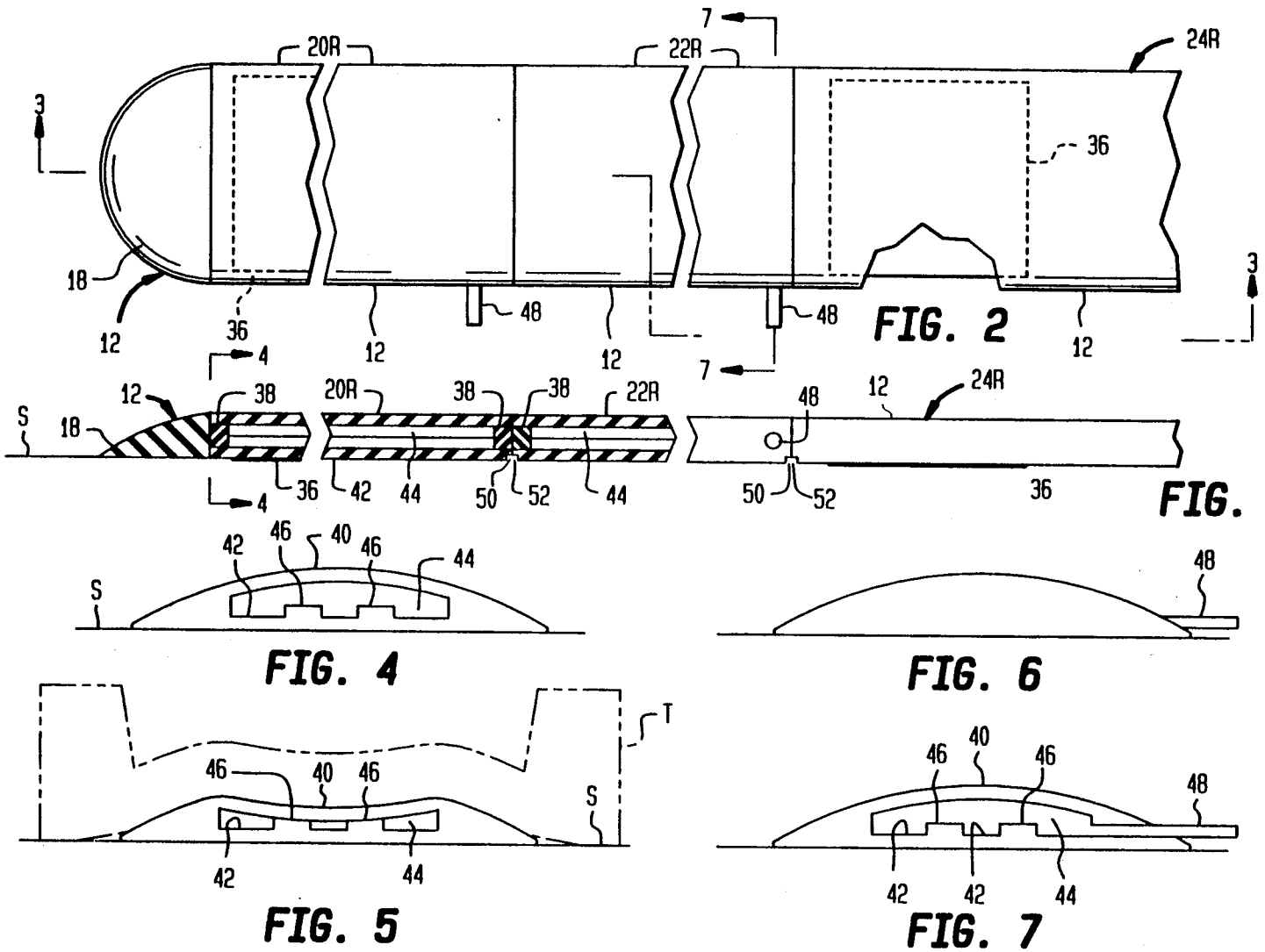
FIG. 2 is a greatly enlarged, fragmentary top plan view of the entrance end of one of the strips, showing the semi-circular end piece and three fragmented sections in abutting, end to end relationship with each other.
FIG. 3 is a longitudinal section substantially on line 3—3 of FIG. 2, on the same scale as FIG. 2.
FIG. 4 is a transverse section, on a scale enlarged above that of FIGS. 2 and 3, taken substantially on line 4—4 of FIG. 3.
FIG. 5 is another sectional view taken on line 4—4 of FIG. 3, in which the top wall of the strip has been depressed by a vehicle tire, the tire being shown fragmentarily and in dash-dotted outline.
FIG. 6 is an end elevational view of one of the sections of strip.
FIG. 7 is a transverse sectional view taken on line 7—7 of FIG. 2.
Figure 8:
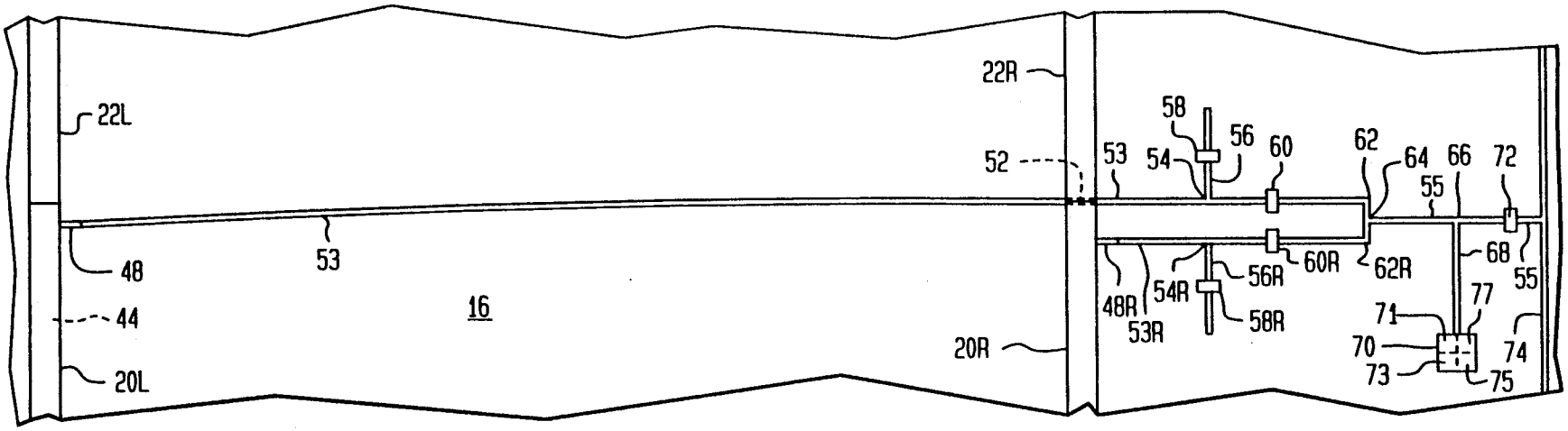
FIG. 8 is an enlarged fragmentary top plan view, illustrating tubing, valves and a signaling unit as used in combination with a pair of section strips.

At the entrance end of the driver check lane 16, the strips have end pieces 18 which, as seen from FIGS. 2 and 3, are of solid rubber, and are generally semi-circular when viewed in top plan, with a top surface (see FIG. 3) that slopes gently upwardly in the sense of the direction in which the vehicle V is traveling as it enters the check lane 16.

End piece 18 is provided with a vertical, straight transverse surface abutted against, but not attached to an end of the entrance section 20 of each strip 12. At this point, it may be noted that the description of the strips, so far as basic structure is concerned, applies to the other, identically formed strip.

Each strip 12 includes, as noted above, an entrance section 20 which may be of any desired length, but which in a typical embodiment might be on the order of about 25 feet long. Each of the additional sections of the strip, which sections will be described hereinafter, would be of corresponding length, so that a particular strip 12, when the inspection system is set up, might be comprised of a total eight pairs of sections, each of which would be of the same length as the other sections (as for example, 25 feet in a typical preferred embodiment).

Figure 9:
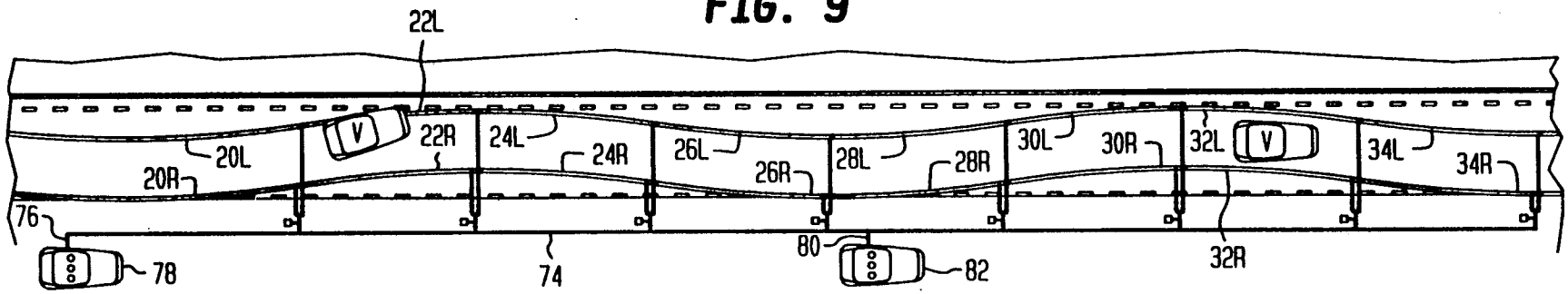
FIG. 9 is an overall top plan view of an active test lane, comprising eight pairs of sections of strips.

In the illustrated examples, (see FIGS. 1 and 9) one strip 12R (the right-hand strip as it would be seen by the driver of vehicle V) begins on the right-hand edge of the normal traffic lane, while the left-hand strip 12L is spaced inwardly from the permanent traffic lane markings 14. Entrance section 20R of the first strip 12R is gently curved to the left, as an arc of a circle, and its end is abutted against an end of oppositely curved section 22R forming a compound curve; section 22R is followed by section 24R which is curved in the same direction as section 22R; section 24R is followed by oppositely curved section 26R; section 26R is followed by section 28R which is curved in the same direction as section 26R. The righthand boundary lane strip is extended to the desired length by alternately placing two abutted together same-direction curved sections after two abutted together oppositely curved sections, forming a series of compound curves. In FIG. 9, the right-hand boundary lane strip is shown, consisting of sections 20R, 22R, 24R, 26R, 28R, 30R, 32R, and 34R; also shown is the left-hand boundary lane strip, consisting of sections 20L, 22L, 24L, 26L, 28L, 30L, 32L and 34L, covering a distance of 200 feet. If a car is following close to another car in the test lane and a signal is activated, the police officer can easier identify the violator if the sections of strips are 25 feet long instead of 100 feet long. When a 25 feet long section is damaged while in use, it can be easier replaced than it would be to replace a 100 feet long section.

The practical length of each section of strip, the overall length of the combined sections of strips, the degree of curvature, the width of the test lane and the speed limit, may all require some experimentation to find the most effective way to use this system.

It is a well known medical fact that a drunk driver's reaction time is slower than a sober driver's reaction time. Just as a drunk driver is unable to quickly steer his vehicle out of the path of an oncoming vehicle to avoid a head on collision, he will be unable to make quick turns from left to right to stay within the test lane.

The strips may be quickly positioned upon the highway surface S, and caused to remain in their assigned positions, through the provision of squares or rectangular pieces of double-sided adhesive sheets 36 (see FIGS. 2 and 3). These are applied to the flat undersides of the various sections, at any locations along the length thereof, and when so applied permit the strips to be temporarily but effectively secured to the surface S in such a way as to assure that they will not be dislocated by vehicle tires.

The particular construction of each section of strip is shown to best advantage in FIGS. 2–7. As seen in FIG. 3, at the beginning of the strip, shown as the left-hand end, there is a solid end block 18, that is semi-circular in top plan view, having a vertical, straight transverse side, abutted against but not attached to one end of entrance section 20R.

Both ends of section 20R ar closed with solid rubber walls 38 that are thicker than the top wall 40 and the bottom wall 42, thereby forming a sealed pressure chamber 44 which is continuous within section 20R through its entire length. The main body of section 20R including pressure chamber 44 has a cross sectional shape shown to best advantage in FIG. 4. As will be noted, the strip section is transversely curved, so that the tire T of a vehicle can ride upwardly thereon without dislodging the strip laterally. Pressure chamber 44 has a flat bottom wall 42, on which transversely spaced, parallel, continuous, low wide spacer ribs 46 are formed. Spaced upwardly, under normal conditions, from ribs 46 is the top wall 40, which is transversely upwardly bulged as shown in FIG. 4, for the full length of the strip.

If the operator of vehicle V is unable to maintain the vehicle within the traffic lane and runs upon section 20R, the tire T of the vehicle will depress the top wall 40, which is flexible, though normally possessed of sufficient resiliency to maintain the form thereof shown in FIG. 4. The top wall 40 is forced downwardly by the tire T, as shown in FIG. 5, into engagement with the spacer ribs 46. The ribs 46 prevent the top wall 40 from completely closing the pressure chamber 44. If a vehicle wheel moves along parallel with and on top of a strip, air will be forced from the forward area to the rear area by way of the channels formed by the upwardly extending ribs, thus preventing a build-up of pressure and bursting of the pressure chamber. It will be noted from FIG. 5, that the depression of the top wall does reduce the total volume of the chamber 44 during the time that the tire T is exerting pressure thereagainst. This, as will be made apparent hereinafter, transmits air pressure through tubes to remote areas to activate electrical switches that control signaling means or to activate other signaling means.

At the exit end, on the right-hand side of section 20R, an opening on pressure chamber 44 is provided, from which a small, short, flexible tube 48 extends horizontally, at a right angle; this is the only opening in pressure chamber 44 of section 20R. Further, section 20R is formed with a small, transverse recess 50 extending from side to side of its exit end. The construction of the counterpart of section 20R, the left-hand section 20L is the same as the construction of section 20R except that it does not have a transverse recess and none of the left-hand sections have transverse recesses. Each succeeding right-hand section has a transverse recess at its entry end and a transverse recess at its exit end, so that when two right-hand sections are abutted together there will be a small transverse opening 52 between them along the bottom edges of the end walls of the two sections.

A length of tube or small pipe 53 is attached to the small, short, flexible tube 48 extending from section 20L. Said tube or small pipe is placed on the roadway surface and extended across the traffic lane, through the opening 52 defined by the recesses in the abutting ends of sections 20R and 22R to a point outside of the test lane. Said tube or pipe is of sufficient strength so as not to yield under weight of vehicles passing over; it is held in place by tape or by other means. A rigid metal tube of ¼ inch inside diameter is believed to be sufficient.

Attached to the tube 53 is a T shaped fitting 54 so that a branch 56 from the tube 53 may extend horizontally at a right angle. In this branch 56 is installed a one way valve 58 that is kept closed under pressure from the pressure chamber 44 but is opened under suction from pressure chamber 44; this is an intake valve to allow air to return into the pressure chamber 44 to replace air expelled by pressure caused by the vehicle tire T. The tube 53 continuing from the T fitting 54, in the original direction, has a one way valve 60 installed on it, so as to allow air to be forced out of pressure chamber 44 but not allow air to return through that opening back into pressure chamber 44.

A length of tube 53R is attached to the small, short, flexible tube 48R extending from section 20R, close to and parallel to tube 53. In the same manner as tube 53, tube 53R is fitted with a one way intake valve 58R and an outgoing, one way valve 60R.

After the one way, outgoing valves, 60 and 60R are installed on tubes 53 and 53R respectively, the two tubes are joined together by elbow fittings 62 and 62R and T fitting 64, becoming as one tube 55.

The now one tube 55 continues in the same direction and is fitted with a T joint 66 providing an outlet branch 68 extending at a right angle from tube 55. This outlet branch 68 leads to a signal unit enclosed in a housing 70. Enclosed in the signal unit housing are a battery 71, a lamp 73 and a pneumatically operated electrical switch 75 equipped with a timer 77. Air pressure is supplied to the signal unit from either the pressure chamber of section 20L or from the pressure chamber of section 20R.

The tube 55 continuing past the signaling unit housing 70 and in the original direction, is fitted with a one way valve 72, to allow air to flow ahead in the tube 55 but not allow air to flow back through the tube 55. After this valve, the tube 55 is attached at a right angle to a long tube 74, that runs parallel to the traffic lane and is essentially the length of the combined lengths of the sections of the boundary lane strips.

Each of the illustrated pairs of sections of signaling boundary lane strips are equipped as sections 20L and 20R and are likewise attached to the long tube 74 that runs along the test lane.

A branch 76, from the long, common tube 74 is extended to a patrol car 78 positioned near the entrance of the signaling boundary lane strips and a branch 80 is extended to a second patrol car 82 positioned near the central area. Near or in each patrol car is a pneumatically operated electrical switch attached to branch 76 or branch 80 and the ends of branches 76 and 80 may be attached to whistles for producing a continuous whistling tone when a tire is running along lengthwise on top of a strip. When any section of strip is run upon, the signal lamp adjacent to that section will be turned on, and simultaneously, signals will be activated in both patrol cars. The timers in the signaling units may be set to allow turned on lamps to stay on for 3 seconds to give police officers time to look and identify the car moving away from the lamp as the lamp goes off. All lamps should be shaded and angled in a manner that light from them will be seen by police officers and not be seen by people in cars in the traffic lane.

OPERATION

FIG. 9 shows an active sobriety test land consisting of 8 pairs of sections of strips, covering a distance of 200 feet; operation of this system involves a distance of highway (not shown) preceding the sobriety test lane and a distance of highway (not shown) following the sobriety test lane.

Typical speeds of vehicles traveling on the type of four lane highway illustrated herein, may range between 50 and 70 miles per hour; hence the first consideration is to reduce speed. This may be accomplished by placing a first sign, a large, high visibility sign bearing the words SLOW DOWN. Positioned near by on the shoulder or farther out from the traffic lane may be a patrol car occupied by one police officer; this will reduce motorists to quickly comply with the 'slow down' sign. The first sign is followed by a series of signs, spaces 100 feet apart. The series of signs are as follows: 1.SLOW DOWN 2.SPEED LIMIT 35 3.SOBRIETY TEST ZONE 4.NO PASSING 5.SIGNS SPACED 100 FEET APART 6.KEEP BACK 100 FEET 7.FROM VEHICLE IN FRONT 8.TRUCKS AND BUSES USE LEFT LANE 9.ALL VEHICLES WITH TRAILERS USE LEFT LANE 10.MOTORCYCLES USE LEFT LANE 11.CARS USE RIGHT LANE 12.VANS AND PICK-UPS 13.HALF TON OR LESS USE RIGHT LANE 14.TRAFFIC LANES NARROW 15.KEEP WITHIN LANE 16.DO NOT TOUCH LANE LINES 17.MAINTAIN 35 MPH A distance of 200 feet is allowed between the last sign and the beginning of the signaling boundary lane strips and no signs are placed along the signaling boundary land strips. The distance between the first sign and the entrance end of the signaling boundary lane strips is 1800 feet; this is the orientation zone.

After the exit from the signaling boundary lane strips, the 35 mph speed limit and the no passing regulation remain in effect in both lanes for a distance of 500 feet; this is the pursuit zone. At the end of the pursuit zone is the interception point and a breath analyzing station. Three hundred feet further along is the last sign which is as follows: END SOBRIETY TEST ZONE.

Deployment of police officers may be as follows: As already indicated, one police officer in a patrol car may be positioned at the onset of the sobriety test operation. Three police officers in three patrol cars may be deployed along the orientation zone to insure that vehicles keep in the proper lanes and to question any driver who leaves the traffic lane and stops on the shoulder. As shown in the drawings, two patrol cars are positioned along the signaling boundary lane strips; each patrol car may be occupied by one police officer. At the interception point and breath analyzing station, may be deployed, two patrol cars, each having one police officer and one police van occupied by one police officer, breath analyzing equipment ect. A second van is also stationed at that location and is occupied by a technician and replacement parts for equipment used in the operation.

When a violation occurs in the test lane, one of the police officers there will proceed on the shoulder to the end of the signaling strips and there cut into the pursuit zone and follow the suspect to the interception point where interception is made in the presence of the police officers stationed there. The pursuit police officer then promptly returns to the original position.

A sobriety test operation, utilizing the DRUNK DRIVER DETECTION SYSTEM set forth herein, may involve nine police officers, one technician, eight patrol cars, one police van and one work van. It is of course, entirely up to the police officers conducting the sobriety test operation, to decide upon the manner of setting up the operation, the number of police officers to be used, the number of vehicles to be used ect.

While a particular embodiment of this invention has been described herein and shown in the drawings, it will be apparent, that many changes may be made in the form, arrangement and positioning of the various elements of the combination. In consideration thereof it should be understood that the preferred embodiment of this invention disclosed herein are intended to be illustrative only and not intended to limit the scope of the invention.

I claim:

1. A readily portable apparatus adapted to be laid out upon a road surface as an aid in checking motorists for possible driver impairment, comprising:

(a) a pair of parallel, basically identically formed lane boundary strips, each section of each strip being curved as an arc of a circle and having a fluid pressure chamber, having closures at both ends thereof sealing the chamber against leakage, said chamber having a resiliently flexible top wall adapted to be depressed by a vehicle tire so as to temporarily reduce the volumetric capacity of the chamber and thereby transmit an increased fluid pressure longitudinally to the ends of said curved section, said curved section having a tube extending horizontally at a right angle to its length, from one end, to carry air pressure to locations remote from said pressure chamber to actuate signals, said sections of right-hand boundary lane strip having a transverse recess at the bottom of each end of each section of strip;

(b) means for temporarily fixing said strips upon a road surface in a transversely spaced relation to form therebetween a traffic lane that is compoundly curved from beginning to end whereby when a vehicle rides upon either of the boundary strips the traffic lane has not been successfully negotiated, and the presence of an impaired driver is indicated;

(c) said left-hand section of boundary lane strip having a rigid, non-yielding tube extending from the tubular opening at its exit end in a direction to the right, across the traffic lane, through the recesses at two abutting ends of sections of right-hand boundary lane strip to points outside of the traffic lane, said right-hand section of boundary lane strip having a tube extending horizontally at a right angle to its length, from its exit end parallel to and close to the tube from the left-hand section, the tube from the left-hand section having a branch tube extending from it at a right angle, said extension being open at its terminus and one way valve on its intermediate portion, said one way valve being installed to remain closed under pressure from the pressure chamber and to open under suction from the pressure chamber, said tube from the right-hand section of boundary lane strip being in the same manner equipped with a one way valve, thereby preventing dissipation of air pressure from the pressure chamber of the left section into the pressure chamber of the right section and vice versa, said tube from the left-hand section extending further in the initial direction being equipped with a second one way valve, said second valve being installed to allow air to flow from the pressure chamber and not allow air to flow back into the pressure chamber, said tube from the righthand section being in the same manner equipped with a second one way valve, said tube from the left-hand section and said tube from the righthand section being joined together and extending further in the initial direction as one tube having a branch tube extending at a right angle from it, said branch tube extending to a housing containing a signaling unit, said signaling unit comprising a battery, a lamp and a pneumatically operated electrical switch with a timer device, said pneumatically operated switch being operable by air pressure against a piston or diaphram in a manner not to discharge air from the pressure chamber, said tube consisting of the combined left and right tubes, continuing in the initial direction and having a one way valve installed in a manner to allow air to flow farther in the initial direction and not allow air to flow back into the signaling unit, after said one way valve, the tube being joined at a right angle to a long tube extending parallel along the traffic lane for a distance that is essentially the length of signaling boundary lane strips, said long tube having two or more spaced apart terminal branches extended to patrol cars standing by, said terminal ends may have whistles attached thereto for emitting sounds as air is expelled or said terminal ends having other signaling devices attached thereto.

2. Apparatus as in claim 1 wherein the inspection lane is defined by a plurality of pairs of arc curved sections laid out forming a series of compound curves, each section of which has a pressure chamber sealed off from pressure chambers of other sections and has at one end of its pressure chamber a tube connected to a signaling unit located outside of the inspection lane whereby to generate signals at locations identifying particular areas of the inspection lane that have not been negotiated successfully.

3. Apparatus as in claim 2 wherein means is provided for any section to actuate the signaling unit attached to it while simultaneously activating signaling devices in patrol cars without activating signaling units attached to other sections.

* * * * *